United States Patent [19]

Weaver

[11] 4,244,154

[45] Jan. 13, 1981

[54] STAIRCASE AND METHOD OF CONSTRUCTION

[76] Inventor: Richard H. Weaver, 520 Ave. H, East, #100, Arlington, Tex. 76011

[21] Appl. No.: 21,549

[22] Filed: Mar. 19, 1979

[51] Int. Cl.[3] ..... E04F 11/12

[52] U.S. Cl. ..... 52/185; 182/115

[58] Field of Search ..... 52/185, 184, 182, 186; 182/83, 115

[56] References Cited

U.S. PATENT DOCUMENTS

| | | | |
|---|---|---|---|
| 3,670,848 | 6/1972 | Raiguel | 52/185 X |
| 3,707,814 | 1/1973 | Seegers | 52/185 |

*Primary Examiner*—J. Karl Bell

*Attorney, Agent, or Firm*—James E. Bradley

[57] ABSTRACT

A staircase for use particularly in buildings with two or more floors. The method of construction includes the step of first suspending a landing frame between floors. The landing frame has at least one straight side for connection to the flight assemblies. The flight assemblies are identical in design, with the steps welded between two stringers. The flight assemblies include bars mounted to the inside of each stringer at the top and bottom to locate the flight assemblies. These bars locate and structurally support the flight assemblies between the floor and the landing.

13 Claims, 9 Drawing Figures

STAIRCASE AND METHOD OF CONSTRUCTION

BACKGROUND OF THE INVENTION

1. Field of the Invention

This invention relates in general to staircases, and in particular to a metal staircase for use in buildings with two or more floors.

2. Description of the Prior Art

Essentially all multiple floor buildings must have one or more staircases. In buildings with two or more floors, the staircases are primarily for emergency use, and are not often used by occupants of the building. Since they are normally not visible, the architects desire an inexpensive nonornamental staircase that meets building code requirements. The buildings will have reinforced concrete floors or structural steel frames with deck and concrete fill. The staircases will have a metal frame, usually with concrete poured in each step and at the landings after erection.

The most commonly used method in construction consists of constructing at a factory a lower flight assembly and an upper flight assembly for each section of the staircase between floors. If the staircase is a right hand staircase, with the wall on the right as the user ascends, then the lower flight assembly will consist of a pair of stringers with steps welded between. Just past the top step, the right hand stringer for the lower flight assembly will have a horizontal channel member extending forwardly to form one side of the landing. The upper flight assembly will have a horizontal channel member extending from the bottom of its right stringer to form the other side of the landing.

To erect a section between floors, both the upper and lower flights must be suspended in place. A back channel member is then attached to the horizontal members to form the landing. Then a header member is installed to support the center part of the stair flight. The flight assemblies are secured together and a plate is placed over the landing members to define a landing. This is a cumbersome and time consuming operation since two flight assemblies have to be suspended at the same time.

Because of the horizontal channel members being secured to the flight assemblies at the factory, the upper and lower flight assemblies cannot be interchanged. If the building requires two staircases, one right hand and the other left hand, the flight assemblies for the right hand staircase cannot be interchanged with the flight assemblies for the left hand staircase. This requires an additional number of noninterchangeable parts, thus adding to the cost of the staircases.

Recently, staircases have been made by first constructing the landing, then securing the upper and lower flight assemblies to it. However, the connection means are complex and the flight assemblies are not interchangeable.

SUMMARY OF THE INVENTION

It is accordingly a general object of this invention to provide an improved staircase and method for construction.

It is a further object of this invention to provide an improved staircase and method for construction in which the lower flight assembly can be welded into position before positioning the upper flight assembly.

It is a further object of this invention to provide an improved staircase and method for construction in which the upper and lower flight assemblies can be interchanged and used with either a right hand or left hand staircase.

It is a further object of this invention to provide a staircase and method for construction having improved connection means for connecting the flight assemblies to the floor and the landing that provides adequate support and is easy to install.

In accordance with these objects, the method includes a step of constructing a rectangular landing frame. The landing frame is first suspended from the building structure between floors. Identical designed flight assemblies are constructed at a manufacturing facility. Each flight assembly comprises two stringers and a plurality of steps. Upper and lower connection means are secured to each stringer. The connection means comprises rectangular bars welded to the inside of each stringer at the top and the bottom, each bar protruding outward horizontally. The lower flight assembly is brought into position between the suspended landing and the floor and secured with connection means. The upper flight assembly is brought into position and secured to the upper floor and the landing with connection means of the same design. Preferably, the header, or front member of the landing frame comprises a rectangular tube. The connection bars are welded to this tube, and floor structure.

DESCRIPTION OF THE PREFERRED EMBODIMENT

Figure 1:
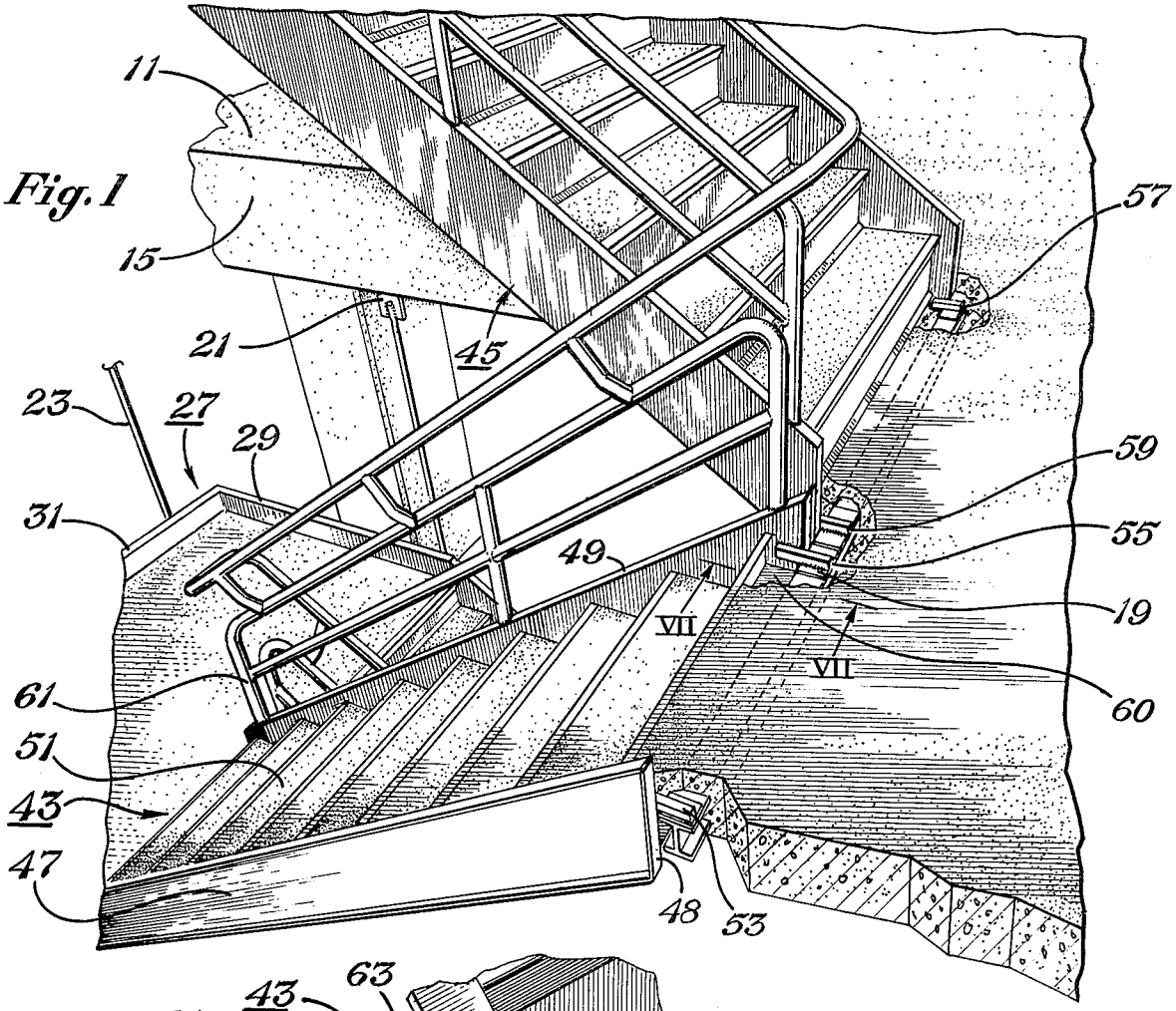
FIG. 1 is a perspective view of portions of a staircase in accordance with the invention.
Figure 3:
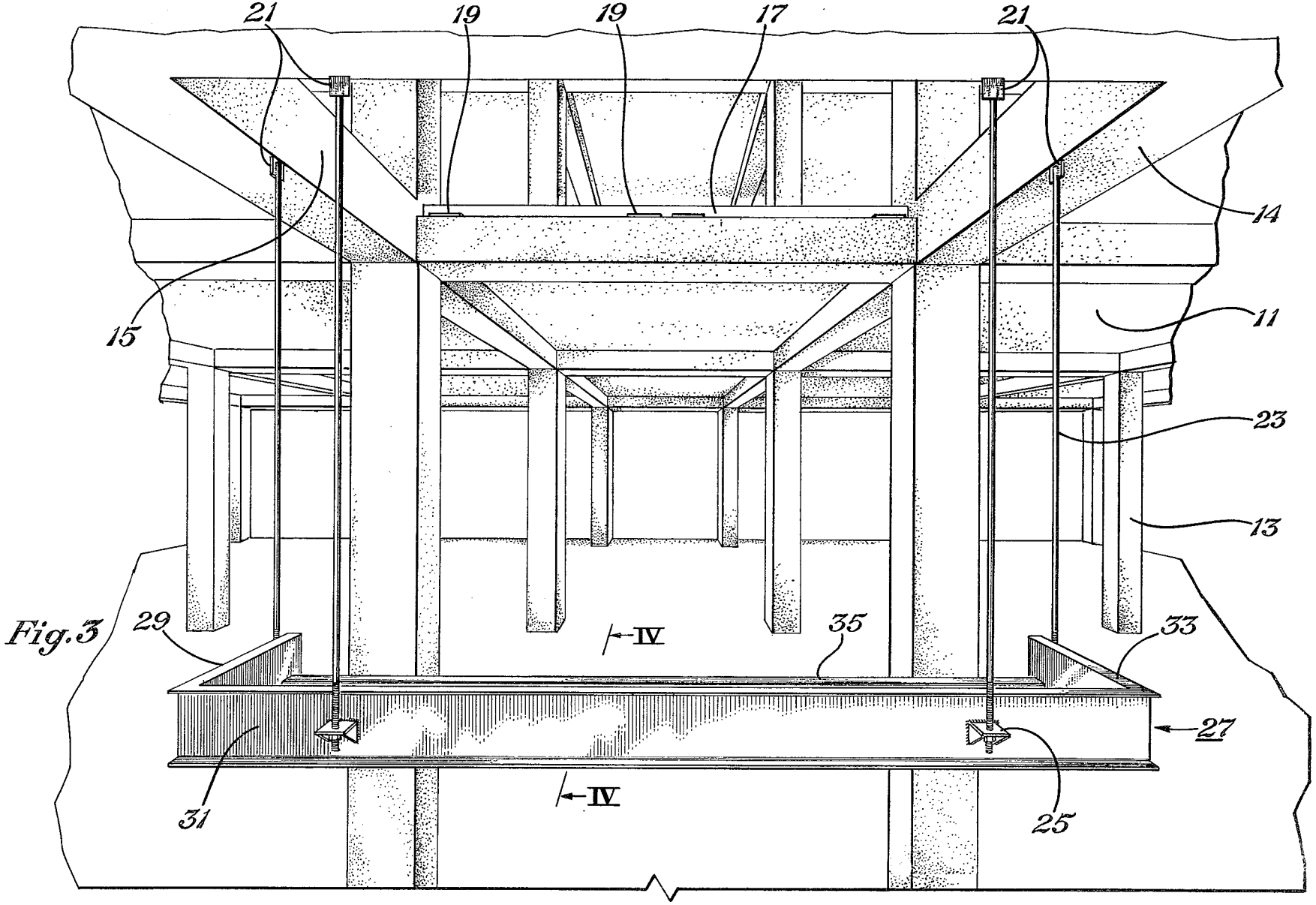
FIG. 3 is a perspective view of the landing frame of the staircase of FIG. 1, with the upper and lower flight assemblies deleted.

Referring to FIGS. 1 and 3, a typical building is shown under construction. Several floors 11 of reinforced concrete or structural steel will be poured or erected before beginning to erect the staircase. Support columns 13 will be located at various points. Horizontal beams 14, thicker than floor 11, are positioned between the vertical columns 13. In pouring the floor 11, rectangular openings 15 will be left for providing the shaft in which the staircase is to be erected.

Figure 7:
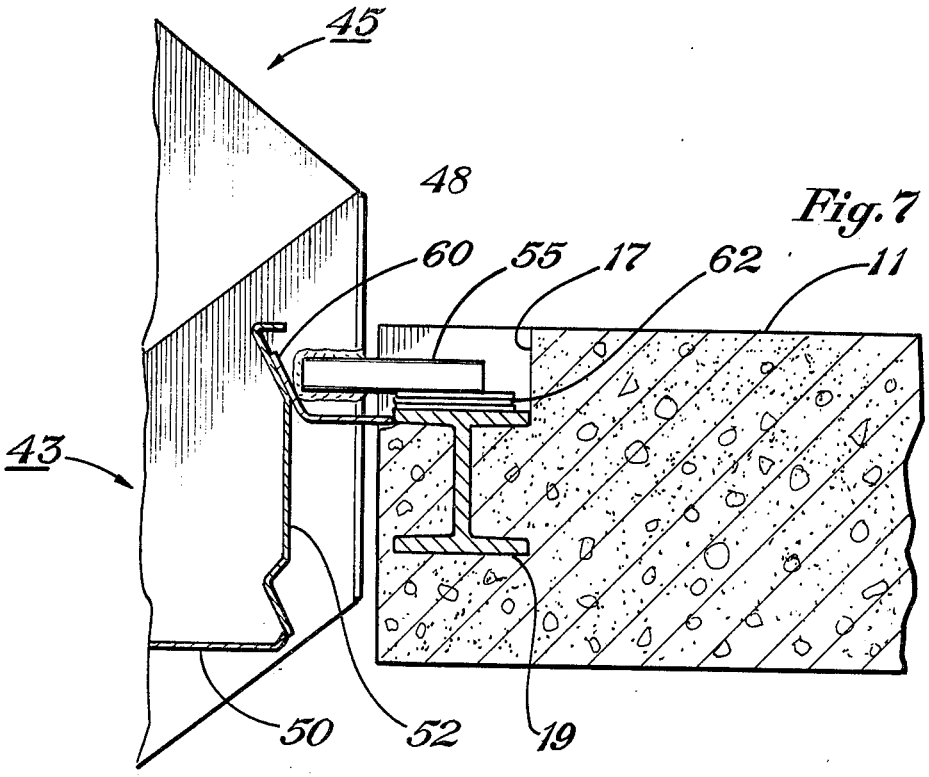
FIG. 7 is a sectional view of the staircase of FIG. 1, taken along the line VII—VII of FIG. 1.

Also, during pouring, a shoulder 17 will be formed in one side of the upper edge or lip of floor 11, or the beam 14, surrounding opening 15. Referring also to FIG. 7, four individual metal bases 19 will be embedded in the horizontal surface of the shoulders 17. Two bases 19 will be positioned on opposite sides, and two bases 19 will be located adjacent each other in the middle. The bases 19 could be of many different configurations. Also during pouring, four brackets 21 will be embedded in the lower surface of the beams 14 bordering opening 15.

Figure 4:
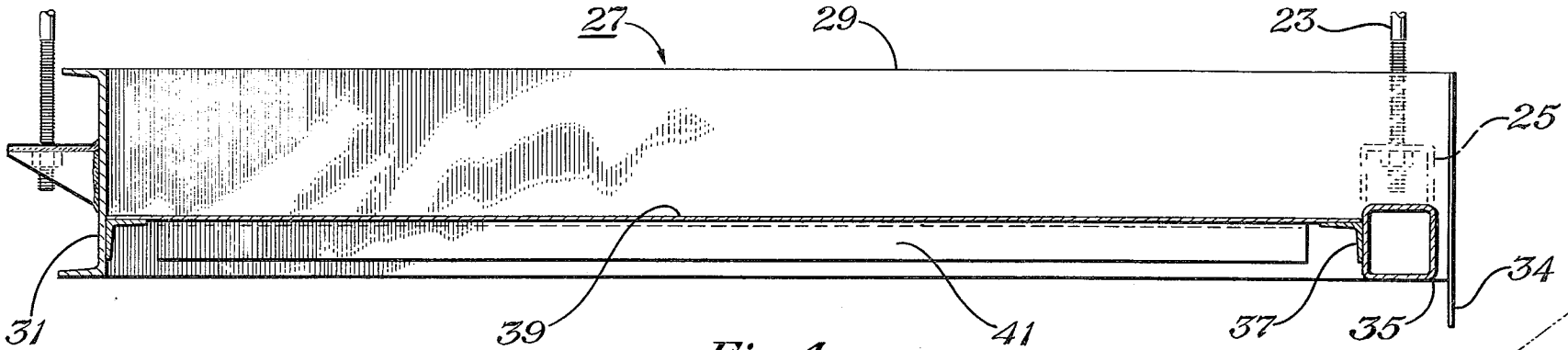
FIG. 4 is a sectional view of the staircase of FIG. 1, taken along the line IV—IV of FIG. 3.

As shown in FIG. 3, a rod 23 is welded to each of the welded brackets 21. Rods 23 have threaded lower ends for receiving hanger brackets 25. A landing frame 27 for each floor is constructed at a manufacturing facility and shipped to the construction site. Each landing frame 27 will be constructed as shown in FIGS. 3 and 4. Each landing frame 27 is rectangular, having three channel members 29, 31 and 33 welded together with the channels facing outward. Channel members 29 and 33 form the sides of the landing frame 27, and channel member 31 forms the back of the landing frame 27. Each side channel member 29, 33 has a closure plate 34 (FIG. 4) shop welded to its front end. A straight member comprising a section of rectangular tubing 35 is welded between side channel members 29 and 33 at the front. Header tube 35 is parallel with the back channel member 31 and perpendicular to the side channel 29 and 33. With 10 inch channel members 29, 31, and 33, the bottom of tube 35 is flush with the bottoms of the channel members 29, 31 and 33. Tube 35 is of considerably less height than the height of channel members 29, 31, 33; for example, the tube 35 may be 3½ inches high, while the channel members may be 10 inches high. Tube 35 is set back from the front edge of the channel members 29 and 33 a short distance.

As shown in FIG. 4, an angle member 37 is welded to the inside of tube 35 and to the insides of channel members 29, 31, and 33. Angle member 37 forms a support for a pan or cover plate 39 that is welded to the landing frame 27 at the construction site. A plurality of angle bars 41 extend across the bottom of plate 39 perpendicular to tube 35 for support. Angle bars 41 are shorter than the plate 39 so that the plate and bar assembly can fit inside the space between the angle members 37.

Figure 5:
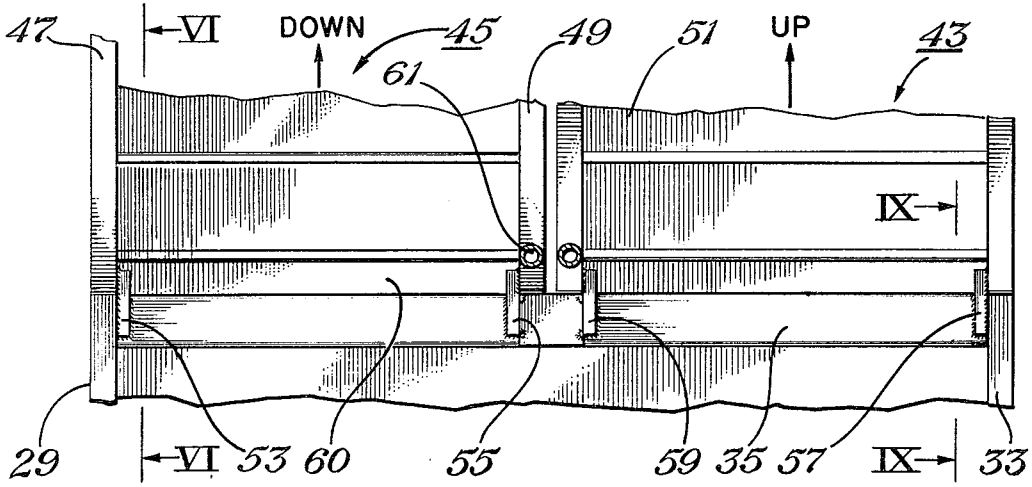
FIG. 5 is a top plan view of a portion of the staircase of FIG. 1.

Referring to FIG. 1, upper and lower flight assemblies 43, 45 for each floor are manufactured at the manufacturing facility and brought to the site. The upper and lower flight assemblies 43, 45 are designed identical, each having a right hand beam or stringer 47, and a left hand beam or stringer 49. Each stringer 47 and 49 has a closure plate 48 shop welded to its ends with a plurality of steps 51 welded between the stringers 47, and 49. Each step 51 comprises a tread 50 and vertical riser 52. "Right hand" and "left hand" refer herein to the position when one is ascending the stairs. Connection means for connecting the flight assemblies 43, 45 to the landing frame 27 and to the floor bases 19 are secured to the stringers 47, 49, at the manufacturing facility. The connection means comprises a pair of upper bars 53, 55 and a pair of lower bars 57, and 59. Referring to FIG. 5, the left hand upper bar 55 is welded to the inside of the left hand stringer 49, at the top and protruding horizontally outward. The right hand bar 53 is welded to the inside of the right hand stringer 47 near the top and protruding horizontally outward. The left hand lower bar 59 is welded to the inside of the left hand stringer 49, near the bottom and protruding horizontally outward. The right hand lower bar 57 is welded to the inside of the right hand stringer 47 near the bottom and protruding horizontally outward. Each bar 53, 55, 57 and 59 is welded to its respective stringer on the top, the lower side, and the back side of the bar to provide adequate strength. Each bar is about five inches long, with two inches welded to the stringer, and three inches protruding outward. The width of each bar is substantially less than the width of the staircase; it being about 1¼ inches, as opposed to a staircase width of four feet or so. The bars are square in transverse cross-section.

Figure 6:
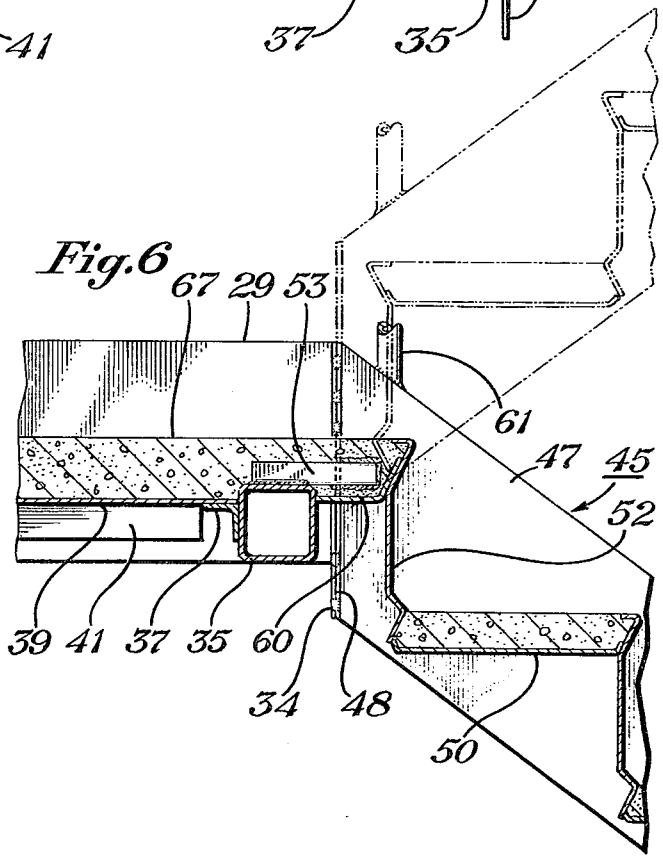
FIG. 6 is a vertical sectional view of the staircase of FIG. 1, taken along the line VI—VI of FIG. 4, with the upper flight assembly shown in phantom.
Figure 9:
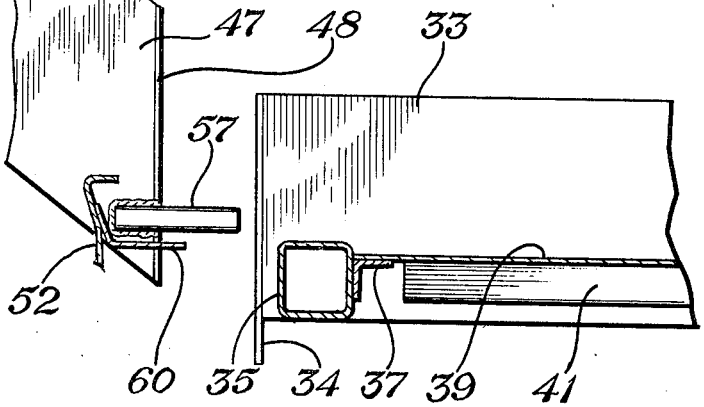
FIG. 9 is a sectional view of the staircase of FIG. 1 taken along the line IX—IX of FIG. 4, but with the flight assembly shown detached to show the method of installation.

As shown in FIG. 6, a filler plate 60 is welded to the top riser 52 below the upper bars 53, 55. Filler plate 60 extends across the width of the flight assembly and protrudes horizontally past the ends of the stringers 47, 49 about one half as far as the bars 53, 55. As shown in FIG. 9, another filler plate 60 protrudes horizontally outward also about one half as far as the lower bars 57, 59. The hand rail 61, as shown in FIG. 1, is welded to the stringers 43, 45 at the site, after they have been erected.

In erecting the staircase, the landing frame 27 is brought to the site with plate 39 detached. It is hoisted into position between floors 11, then hanger rods 23 are attached to the hanger bracket 25, 31 and 33, which are shop welded to channel members 29. Then plate 39 is placed into position and welded to the landing frame 27.

Figure 2:
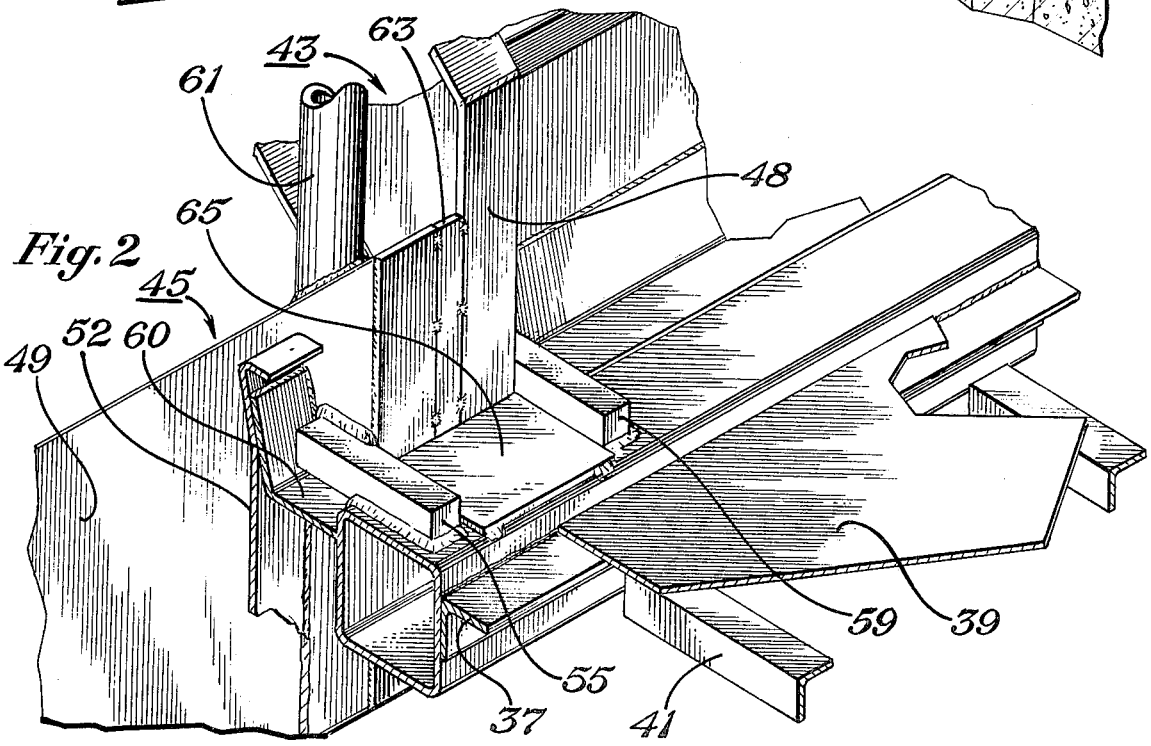
FIG. 2 is an enlarged perspective view, partially broken away, of part of the staircase of FIG. 1.
Figure 8:
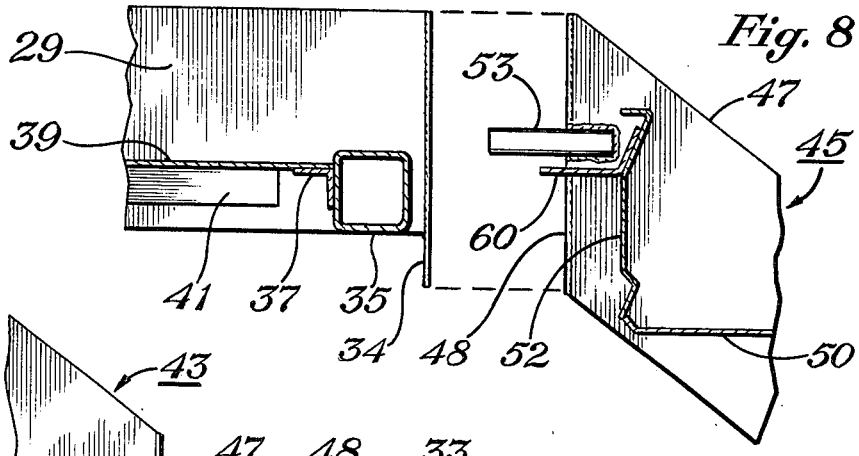
FIG. 8 is a sectional view of the staircase of FIG. 1, taken along the line VI—VI of FIG. 4, but with the flight assembly shown detached to show the method of installation.

After the landing frame 27 is suspended, the lower stringer 45 is hoisted into position, as shown in FIG. 1, by placing the lower bars 57, 59 on the bases 19 (FIG. 3 and 7) on the lower floor 11. For leveling, a plurality of shims 62 may be placed on top of the bases 19, below the contact bars 57, 59. Shims 62 are considered to be an integral part of bases 19 after welding. Upper bars 53, are placed on the landing frame tube 35. FIG. 8 shows the lower flight assembly being moved into position, the final position being shown in FIG. 6. In the final position, as shown in FIG. 7, a clearance exists between the lower ends of the stringers 47, 49 and the floor 11. A clearance exists at the top, as shown in FIG. 6, between tube 35 and the upper ends of the stringers 47, 49. These clearances allow the flight assembly 43 to be shifted to some extent to account for variations in floor 11. The upper and lower clearances are closed off below by filler plates 60. The lower bars 57, 59, are welded to the shims 62 and to the bases 19, while the upper bars 53 and 55 are welded to tube 35. The weld on the left hand upper bar 55 is shown in FIG. 2. The closure plates 48 on the upper ends of stringers 47 and 49 will abut the closure plates 34 on the ends of channel members 29 and 33. These closure plates 34 and 48 are also welded to each other in the field.

The upper flight assembly 43 is then hoisted into place. The lower bars 57, 59 are placed on tube 35 adjacent the lower stringer 45. The upper bars 53, 55 are placed on shims 62 and bases 19. Bars 53, 55, 57 and 59 are then welded in place. FIG. 8 shows the lower end of the upper flight assembly 43 being moved into position, and FIG. 7 shows the upper end of the upper flight assembly in place. Then, as shown in FIG. 2, a second filler plate 63 is welded between the base of the left hand stringer 49 of the upper flight assembly 43, and the top of the left hand stringer 49 of the lower flight assembly 45. A third filler plate 65 is welded to tube 35 between bars 55 and 57, as shown in FIG. 2. The closure plate 48 on the bottoms of stringers 47 and 49 are welded to closure plate 34.

Once the entire staircase is welded into place, concrete can be poured into the steps, over plate 39, and into shoulder 17. Filler plates 60, 63 and 65 do not provide structural support but prevent concrete from pouring through and dropping below the staircase. Subsequently, a wall will be installed to enclose the staircase to define a shaft through the opening 15. Although there may be some differences in several floors of a building for architectural features, the staircases for each foor will have identical design. If the landing is selected to be positioned midway between floors, the upper and lower flight assemblies 43 and 45 can be interchanged. In any case, the flight assemblies can be used either with a right hand staircase as shown, or with a left hand staircase. The landing frames 27 are also interchangeable.

It should be apparent that an invention having significant advantages has been provided. The method of erection by using rectangular bars allows fast positioning, welding and structural strength. The flight assemblies are interchangeable with each other and can be used with right hand or left hand staircases.

While the invention has been shown in only one of its forms, it should be apparent to those skilled in the art that it is not so limited but is susceptible to various changes and modifications without departing from the spirit thereof.

I claim:

1. A method of constructing a metal frame staircase between floors and in a building, the floors above the base of the staircase having openings for the staircase with a base on one edge of each of the openings, the method comprising in combination:

suspending a rectangular landing frame from the building structure between two of the floors and openings, the landing frame having a straight frame member on one side;

constructing for each part of the staircase between floors, an upper and a lower flight assembly, each flight assembly being substantially identical to each other, and comprising a plurality of steps secured between two stringers;

welding an upper bar to the inside of each stringer at the top, and a lower bar to the inside of each stringer at the bottom, and positioning the two upper bars and two lower bars such that they protrude horizontally outward past the stringers;

positioning the lower flight assembly between the base on the lower floor and the landing frame, with the lower bars resting on the lower floor base and the upper bars resting on the straight member of the landing frame, then welding the upper and lower bars to the straight member and the lower floor base, respectively; and positioning the upper flight assembly between the landing frame and the upper floor, with the lower bars resting on the straight member of the landing frame and the upper bars resting on the upper floor base, then welding the upper and lowers bars to the upper floor base and the straight member respectively.

2. The method according to claim 1 wherein the straight member comprises a rectangular tube.

3. The method according to claim 1 wherein the upper and lower bars are substantially square in transverse cross-section.

4. The method according to claim 1 wherein the step of suspending the landing frame from the building includes the steps of securing rods to the upper floor, and securing the landing frame to the lower ends of the rods.

5. A method of constructing a metal frame staircase between floors in a building, the floors above the base of the staircase having aligned openings for the staircase, the method comprising in combination:

providing a shoulder in the upper edge of the openings;

providing a metal base in the lower surface of each of the shoulders;

constructing for each part of the staircase between floors, an upper and a lower flight assembly, each flight assembly being substantially identical to each other and comprising a plurality of steps secured between two stringers;

welding a rectangular upper bar to the inside of each stringer at the top and a rectangular lower bar to the inside of each stringer at the bottom, and positioning the two upper bars and the two lower bars so that they protrude horizontally outward past the stringers, and are located intermediate the upper and lower edges of the stringers;

constructing a rectangular landing frame, with one side of the landing frame comprising a rectangular tube;

suspending from the lower side of each floor a plurality of rods around the opening;

securing the landing frame to the rods between the floors and between the openings;

securing a landing plate over the landing frame to define a landing;

positioning the lower flight assembly between the lower floor base and the landing frame, with the lower bars resting on the lower floor base and the upper bars resting on the tube, then welding the upper and lower bars to the tube and to the lower floor base, respectively; and positioning the upper flight assembly between the landing frame and the upper floor, with the lower bars resting on the tube and the upper bars resting on the upper floor base, then welding the upper and lower bars to the upper floor base and to the tube, respectively.

6. The method according to claim 5 wherein the upper and lower floor base each comprise a plurality of individual bases spaced apart, each base supporting a single bar.

7. The method according to claim 5 wherein the landing frame is constructed by welding a back channel member between the ends of two side channel members, and welding the tube between the other ends of the side channel members, the channels of the channel members being substantially greater than the height of the tube, the bottom surface of the tube being flush with the lower edges of the channel members.

8. The method according to claim 7 wherein the landing plate is secured to the landing frame by securing an angle member to the inside of the tube, the side channel members, and the back channel members for support from the plate.

9. The method according to claim 5 wherein the method further includes the step of pouring concrete over steps, the landing plate and the shoulders, after the flight assemblies have been welded into place.

10. A metal staircase for erection between openings in floors in buildings of the type having a metal landing suspended between floors, a lower flight assembly extending from the lower floor to the landing, and an upper flight assembly extending from the landing to the upper floor, each flight assembly having a plurality of steps welded between two stringers, an improved means for connecting the upper and lower flight assemblies to the landing, comprising:

a rectangular tube welded across the front of the landing;

a metal base at the floors at the ends of the openings;

an upper bar mounted to the inside of each stringer at the top, and a lower bar welded to the inside of each stringer at the bottom, the two upper and two lower bars protruding outward past the ends of the stringers and being located intermediate the upper and lower edges of the stringers;

the lower bars of the lower flight assembly being welded to the floor base and the upper bars of the lower flight assembly being welded to the tube during erection;

the lower bars of the upper flight assembly being welded to the tube, and the upper bars of the upper flight assembly being welded to the upper floor base during erection.

11. The apparatus according to claim 10 wherein the bars are substantially square in transverse cross-section.

12. The apparatus according to claim 10 further comprising:

a filler plate extending across each of the flight assemblies at the top and at the bottom below the upper and lower bars, respectively, and protruding outward for a distance less than the bars, to contact the floor and the tube to retain concrete during pouring.

13. The apparatus according to claim 10 wherein the landing comprises:

a back channel member and two side channel members welded together with the tube welded between the side channel members perpendicular to them and parallel with the back channel member, the channel of each channel member facing outward, the height of the channel members being substantially greater than the height of the tube, the bottom surface of the tube being flush with the lower edge of the channel members.

* * * * *